US011390100B2

(12) United States Patent
Simon

(10) Patent No.: US 11,390,100 B2
(45) Date of Patent: Jul. 19, 2022

(54) METHOD AND DEVICE FOR PROCESSING WATER-BASED INKJET INKS FOR DIGITAL CONTACTLESS INKJET PRINTING

(71) Applicant: TRITRON GMBH, Battenberg-Dodenau (DE)

(72) Inventor: Jens Simon, Hatzfeld (DE)

(73) Assignee: TRITRON GMBH, Battenberg-Dodenau (DE)

( * ) Notice: Subject to any disclaimer, the term of this patent is extended or adjusted under 35 U.S.C. 154(b) by 0 days.

(21) Appl. No.: 16/617,649

(22) PCT Filed: May 29, 2018

(86) PCT No.: PCT/DE2018/100521

§ 371 (c)(1),
(2) Date: Nov. 27, 2019

(87) PCT Pub. No.: WO2018/219409

PCT Pub. Date: Dec. 6, 2018

(65) Prior Publication Data

US 2020/0114665 A1 Apr. 16, 2020

(30) Foreign Application Priority Data

May 30, 2017 (DE) ..... 10 2017 111 850.0
Dec. 5, 2017 (DE) ..... 10 2017 128 900.3

(51) Int. Cl.
*B41J 29/377* (2006.01)
*B41J 2/045* (2006.01)

(52) U.S. Cl.
CPC ..... *B41J 29/377* (2013.01); *B41J 2/04566* (2013.01); *B41J 2/04581* (2013.01)

(58) Field of Classification Search
CPC ..... B41J 2/215; B41J 2202/02; B41J 2/165; B41J 2/1714
See application file for complete search history.

(56) References Cited

U.S. PATENT DOCUMENTS

2013/0127945 A1 5/2013 Vincent et al.
2013/0293621 A1 11/2013 Tunmore et al.

FOREIGN PATENT DOCUMENTS

DE 102014118295 A1 * 6/2016 ..... B41J 2/1714
FR 2965214 A1 * 3/2012 ..... C09D 11/033
WO 03091028 A1 11/2003

OTHER PUBLICATIONS

International Search Report, PCT/DE2018/100521, dated Sep. 10, 2018, 2 pages.

(Continued)

*Primary Examiner* — Julian D Huffman
(74) *Attorney, Agent, or Firm* — Stinson LLP

(57) ABSTRACT

A method for processing water-based low-viscosity liquid inkjet inks for digital, contactless inkjet printing, wherein the inkjet ink is applied from systematically arranged nozzles in a time-dependent and location-dependent manner and divided into individual volume units, characterized in that the inkjet ink at the nozzle outlet is or is being cooled to temperatures below the temperature of the ambient air. A device for processing water-based low-viscosity liquid inkjet inks for digital, contactless inkjet printing, comprising at least one print head, whereby inkjet inks are applicable from systematically arranged nozzles in a time-dependent and location-dependent manner and divided into individual volume units, characterized in that the print head and/or the inkjet ink supplied to the print head is coolable.

15 Claims, 1 Drawing Sheet

(56) References Cited

OTHER PUBLICATIONS

Written Opinion, PCT/DE2018/100521, dated Sep. 10, 2018, 7 pages.

* cited by examiner

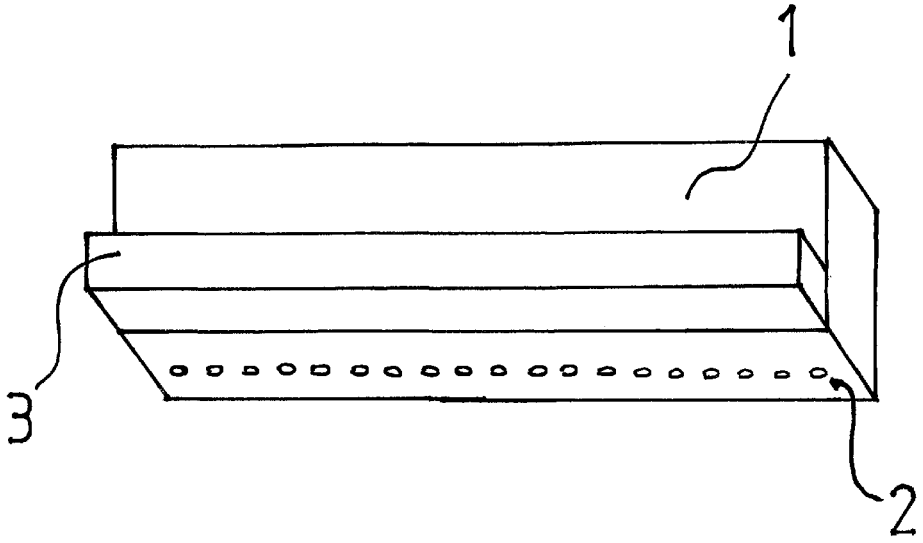
1
3
2

METHOD AND DEVICE FOR PROCESSING WATER-BASED INKJET INKS FOR DIGITAL CONTACTLESS INKJET PRINTING

REFERENCE TO RELATED APPLICATIONS

This application is a U.S. national stage application based on PCT/DE2018/100521, filed May 29, 2018, claiming priority to German application no. 10 2017 111 850.0, filed May 30, 2017 and German application no. 10 2017 128 900.3, filed Dec. 5, 2017, the entire disclosures of which are incorporated herein by reference.

BRIEF DESCRIPTION OF THE INVENTION

The invention relates to a method according to the preamble of claim 1, namely a method for processing water-based, low-viscosity liquid inkjet inks for digital, contactless inkjet printing, wherein the inkjet ink is applied from systematically arranged nozzles in a time-dependent and location-dependent manner and divided into individual volume units.

Moreover, the invention relates to a device according to the preamble of claim 11, namely a device for processing water-based, low-viscosity liquid inkjet inks for digital, contactless inkjet printing, comprising at least one print head (1, FIG. 1), whereby inkjet inks can be applied from systematically arranged nozzles (2, FIG. 1) in a time-dependent and location-dependent manner and divided into individual volume units.

The invention provides a novel method for processing water-based, low-viscosity liquid (highly fluid) inkjet inks for digital, contactless inkjet printing using batch (drop on demand, DoD) systems which are activated piezoelectronically.

The method according to the invention compensates for the evaporation rate of water evaporating from the inkjet inks present at the nozzle outlet (liquid phase) into the surrounding atmosphere (gaseous phase) and the condensation rate of water vapor from the surrounding atmosphere into the inkjet inks at the nozzle outlet by sufficiently reducing the evaporation rate by cooling or by sufficiently increasing the condensation rate by saturating the surrounding atmosphere with water vapor.

The method limits the evaporation of water at the nozzle outlet and ensures systematic processing of water-based inkjet inks without limiting dryability of applied inkjet ink. Cleaning and maintenance procedures are minimized.

BACKGROUND OF THE INVENTION

In digital, contactless inkjet printing, low-viscosity liquid (highly fluid) inkjet inks are applied from systematically arranged nozzles in a time- and location-dependent manner and divided in individual volume units (droplets). Formation of droplets is required to occur more predictable, and, regarding the inkjet ink, directly depends on ink density, surface tension and deformation- and flow characteristics. With regard to corresponding printing systems, the formation of droplets is largely determined by the supplied energy as a function of time (excitation function).

At the nozzle outlet, the highly fluid inkjet inks come into contact with the surrounding atmosphere, and they contain components which, at a temperature greater than 0 Kelvin, tend to disappear from the liquid composition. These components particularly include solvent or diluent components. These components are volatile and, depending on their temperature and partial pressure, migrate from the liquid phase into the gaseous phase in varying quantities over time. Solvent or diluent components evaporate—solute or dispersed components dry out. The amount evaporating per unit time is called evaporation rate, additionally depending on the surface curvature of the liquid and the saturation of the respective components in the surrounding atmosphere.

A typical solvent or diluent component of highly fluid inkjet inks is water.

BRIEF DESCRIPTION OF THE FIGURE

FIG. 1 is schematic representation of a system used in carrying out the method of the invention.

DETAILED DESCRIPTION OF PREFERRED EMBODIMENTS

Flowability (viscosity) of water-based inkjet inks may increase quite fast at the nozzle outlet and especially at the interface between the liquid and the surrounding atmosphere. The changing viscosity is variable in scope and course, thus leading to unpredictable formation of droplets restricting the functionality of corresponding printing systems. As to the formulation, water is replaced by less volatile components, so-called drying retarders, to limit overall evaporation rates of water-based inkjet inks. Cleaning and maintenance methods are made use of in regard of corresponding printing systems to replace inkjet inks present at the nozzle outlet having an increased viscosity by those having a specified viscosity.

Limitation of the evaporation of water-based inks by using low-volatility drying retarders is especially disadvantageous when drying of applied inks is required, as it is especially the case with poorly absorbent or non-absorbent print media. Cleaning and maintenance procedures require interruption of the printing process. Interruptions limit productivity and, in this respect, are also disadvantageous. This is especially true in single-pass printing, but also in multi-pass printing.

The object of the invention is to provide a method wherein evaporation of volatile components from water-based inkjet inks, and especially evaporation of water itself, can be regulated at the nozzle outlet at the interface between inkjet inks and the surrounding atmosphere without restricting the dryability of applied inkjet inks. Another object of the invention is to minimize interruptions due to cleaning and maintenance processes. In addition, an appropriate device is to be provided.

The problem will be solved by providing a method according to the features of claim 1. Accordingly, a previously mentioned method is further developed such that the inkjet ink at the nozzle outlet is or is being cooled to temperatures below the temperature of the ambient air.

A device according to the invention is provided with the features of claim 11. Accordingly, a previously mentioned device is further developed such that the print head and/or the inkjet ink supplied to the print head is able to be cooled.

Advantageous embodiments and further developments of the invention accord to the subject matter of the subordinate claims.

Methods and devices according to the invention are the subject matter of the following explanations. Advantageous embodiments and further developments of the teaching will also discussed.

Depletion of water at the nozzle outlet may be reduced to 0 kg/s if the surrounding atmosphere exactly absorbs as much water from the water-based inkjet ink as it releases to the water-based inkjet ink. This condition occurs when the evaporation rate of water from the inkjet inks present at the respective nozzle outlet to the surrounding atmosphere is equal to the condensation rate of water vapor from the surrounding atmosphere into the inkjet inks at the respective nozzle outlet. The required compromise can be achieved by sufficiently reducing the evaporation rate by cooling, and/or by sufficiently increasing the condensation rate by saturating the surrounding atmosphere with water vapor.

It has been shown to be advantageous to cool the inkjet ink present at the nozzle outlet to temperatures below ambient air temperature to limit water evaporation.

Alternatively or additionally, but also preferably, the condensation rates can be sufficiently increased by saturating the surrounding atmosphere with water vapor.

"Surrounding atmosphere" refers to the atmosphere surrounding the nozzle outlet. In this respect, the surrounding atmosphere corresponds to the ambient air mentioned above.

Within the scope of the invention, the temperature of the inkjet ink present at the nozzle outlet should preferably be regulated based on the relative humidity of the ambient air. Relative humidity is the ratio of the actual mass of water vapor in the atmosphere to the maximum mass of water vapor that can be absorbed by the atmosphere (maximum humidity).

Regulation of the cooling temperature of the inkjet inks at the nozzle outlet based on the relative humidity of the ambient air allows for the evaporation rate of water from the inkjet inks present at the nozzle outlet into the surrounding atmosphere to be precisely adjusted to match the condensation rate of the water vapor from the surrounding atmosphere into the inkjet inks present at the nozzle outlet. For this purpose, the saturated vapor pressure (equilibrium vapor pressure) of water in the inkjet ink present at the nozzle outlet is set via the temperature such that it matches the partial pressure of the water vapor in the surrounding atmosphere.

The saturated vapor pressure of a substance is the pressure at which the gaseous state of aggregation is in equilibrium with the liquid state of aggregation with regard to the evaporation rate of water and the condensation rate of water vapor—the saturated vapor pressure will be reached at the dew point temperature. The dew point temperature may be determined by measuring the relative ambient air humidity. When regulating the cooling temperature, as described above, the inkjet inks present at the nozzle outlet will undergo temperature fluctuations which, like evaporation of water, result in viscosity changes. In contrast to viscosity changes resulting from water evaporation, viscosity changes resulting from temperature changes are well controllable and may easily be compensated for the respective ink by the excitation functions that are adapted to the temperature.

Selection of an unregulated defined cooling temperature is required when the printing system only has one excitation function per inkjet ink. In this case, it is advantageous to regulate the relative ambient air humidity on the basis of a specified temperature of the ink at the nozzle outlet, which must be below room temperature, and preferably between 0 and 20° C.

In an advantageous aspect of the invention, relative humidity of the atmosphere surrounding the nozzle outlet may be at least 75% in relation to the temperature of the ink at the nozzle outlet. The term "in relation to the temperature of the ink" means that it is fictively assumed that the surrounding atmosphere has the temperature of the ink. Then, the relative humidity of at least 75% is to be understood based on this assumption.

Cooling of inkjet inks at the nozzle outlet can be achieved by cooling the print head and/or by cooling the inkjet inks supplied. Cooling of inks at the nozzle outlet together with the print head can be implemented very advantageously if the ink circulates through the print head having been sufficiently cooled aside from the print head. Dependent or independent thereof, the print head may advantageously be cooled with a Peltier element (3, FIG. 1) attached to it in an appropriate manner, or with several Peltier elements attached to it in an appropriate manner.

Depletion of water from the inkjet inks at the nozzle outlet can also be reduced if the condensation rate of water vapor in the surrounding atmosphere is increased by saturating the surrounding atmosphere with water vapor. Saturation of the surrounding atmosphere with water vapor can be achieved by appropriately humidifying the surrounding atmosphere, or by cooling the temperature down to the dew point temperature of the surrounding atmosphere.

Supplemental to respectively in addition to the already discussed advantageous embodiments and further developments, the invention will be described below by making reference to further embodiments, which, however, do not restrict the invention to the described embodiments.

Embodiment 1

A method for processing water-based low-viscosity liquid inkjet inks for digital, contactless ink printing, wherein the ink at the nozzle outlet is or is being cooled to temperatures below the ambient air temperature.

Embodiment 2

The method according to embodiment 1, wherein the temperature of the inkjet ink at the nozzle outlet is regulated such that it is below room temperature, and in particular between 0 and 20° C.

Embodiment 3

The method according to embodiment 1 or 2, wherein the temperature of the inkjet ink at the nozzle outlet is regulated by cooling the print head and/or by cooling the supplied inkjet ink.

Embodiment 4

A method for processing water-based low-viscosity liquid inkjet inks for digital, contactless ink printing, optionally according to one or more of the preceding embodiments, wherein the condensation rate is increased by saturating the atmosphere surrounding the nozzle outlet with water vapor.

Embodiment 5

The method according to one or more of the preceding embodiments, wherein the evaporation rate of water from the respective inkjet inks present at the nozzle outlet into the surrounding atmosphere is substantially adapted to the condensation rate of the water vapor from the surrounding atmosphere into the respective inkjet inks present at the nozzle outlet.

Embodiment 6

The method according to one or more of the preceding embodiments, wherein the evaporation rate of water from the respective inkjet inks present at the nozzle outlet into the surrounding atmosphere is exactly adapted to the condensation rate of the water vapor from the surrounding atmosphere into the respective inkjet inks present at the nozzle outlet.

Embodiment 7

The method according to one or more of the preceding embodiments, wherein the relative humidity of the atmosphere surrounding the nozzle outlet is at least 75% in relation to the temperature of the ink present at the nozzle outlet.

Embodiment 8

The method according to one or more of the preceding embodiments, wherein the temperature of the respective inkjet ink present at the nozzle outlet matches the actual dew point temperature of the surrounding atmosphere.

Embodiment 9

A device for processing water-based, low-viscosity liquid ink printing inks for digital, contactless ink printing, comprising at least one print head, wherein the print head and/or the inkjet ink supplied to the print head is coolable.

Embodiment 10

A device for processing water-based, low-viscosity liquid ink printing inks for digital, contactless ink printing, optionally according to embodiment 9, wherein the device is designed such that the ink is coolable outside of the print head and, in the cooled state, may circulate through the print head.

Embodiment 11

The device according to embodiment 9 or 10, wherein the device comprises at least one Peltier element, particularly wherein at least one Peltier element is assigned to a print head, and/or wherein there are arranged several Peltier elements appropriately installed for cooling the ink.

Many other embodiments of the present invention are conceivable, which can arbitrarily be assembled from combinations of all characteristics disclosed herein. In particular, characteristics of the advantageous configurations and embodiments of the invention described above can be combined in any way in order to achieve other advantageous configurations of the invention.

While the present invention has been described in detail on the basis of the advantageous embodiments and further developments described above as well as the embodiments listed above, it is understood by the person skilled in the art that variations or modifications by different combining of individual characteristics, or by omitting individual characteristics, are possible without departing from the scope of the invention.

The invention claimed is:

1. A method for processing water-based liquid inkjet inks for digital, contactless inkjet printing using a device comprising at least one print head, wherein the inkjet ink is applied from systematically arranged nozzles in a time-dependent and location-dependent manner and divided into individual volume units, wherein inkjet inks at nozzle outlets are cooled to below ambient air temperature, the method comprising:

measuring the air temperature and relative humidity of the ambient air;

regulating the cooling temperature of the inkjet inks at the nozzle outlet based on the relative humidity of the ambient air, such that the evaporation rate of water from the respective inkjet inks present at the nozzle outlets into the ambient atmosphere is substantially adapted to a condensation rate of the water vapor from the ambient atmosphere into the inkjet inks present at the nozzles.

2. The method according to claim 1, characterized in that the temperature of the inkjet inks at the nozzle outlets is regulated such that it is below the room temperature.

3. The method according to claim 2, characterized in that the temperature of the inkjet inks at the nozzle outlets is regulated such that it is between 0 and 20° C.

4. The method according to claim 1, characterized in that regulation of the temperature of the inkjet inks at the nozzle outlets is done by cooling the print head.

5. The method according to claim 1, characterized in that regulation of the temperature of the inkjet inks at the nozzle outlets is done by cooling the supplied inkjet ink.

6. The method according to claim 1, characterized in that the evaporation rate of water from the inkjet inks present at the respective nozzle outlets into the surrounding atmosphere is adapted to the condensation rate of the water vapor from the surrounding atmosphere into the inkjet inks present at the nozzle outlets.

7. The method according to claim 1, characterized in that the evaporation rate of water from the inkjet inks present at the respective nozzle outlets into the surrounding atmosphere is exactly adapted to the condensation rate of the water vapor from the surrounding atmosphere into the inkjet inks present at the nozzle outlets.

8. The method according to claim 1, characterized in that the relative humidity of the atmosphere surrounding the nozzle outlets, in relation to the temperature of the inks at the nozzle outlets, is at least 75%.

9. The method according to claim 1, characterized in that the temperature of the respective inkjet inks present at the nozzle outlets matches the actual dew point temperature of the surrounding atmosphere.

10. A method for processing water-based liquid inkjet inks for digital, contactless inkjet printing, wherein the inkjet ink is applied from systematically arranged nozzles in a time-dependent and location-dependent manner and divided into individual volume units, wherein inkjet inks at nozzle outlets are cooled to below ambient air temperature, the method comprising increasing a condensation rate by saturating the atmosphere surrounding the nozzle outlet with water vapor.

11. A device for processing water-based liquid inkjet inks for digital, contactless inkjet printing, comprising at least one print head, whereby inkjet inks are applicable from systematically arranged nozzles in a time-dependent and location-dependent manner and divided into individual volume units, wherein the device comprises a cooling device which cools the inkjet inks outside of the print head and the device circulates the inkjet inks in the cooled state through the print head, and wherein the device further comprises a humidifier configured to saturate the atmosphere surrounding outlets of the nozzles with water vapor during printing.

12. The device according to claim 11 wherein the cooling device comprises at least one Peltier element for cooling the inkjet inks outside of the print head.

13. The device according to claim 12, comprising a Peltier element for cooling the print head in addition to the at least one Peltier element for cooling the inkjet inks outside of the print head.

14. The device according to claim 12, characterized in that there are arranged several Peltier elements appropriately installed for cooling the ink.

15. The device of claim 11 wherein the print head is cooled independently of the inkjet inks.

* * * * *